United States Patent [19]

Jayaram

[11] Patent Number: 5,051,089

[45] Date of Patent: Sep. 24, 1991

[54] INTEGRAL PILOT BURNER-GENERATOR

[75] Inventor: M. R. Jayaram, Cypress, Calif.

[73] Assignee: Honeywell Inc., Minneapolis, Minn.

[21] Appl. No.: 666,491

[22] Filed: Mar. 6, 1991

Related U.S. Application Data

[63] Continuation of Ser. No. 375,115, Jun. 30, 1989, abandoned.

[51] Int. Cl.[5] ..... F23N 5/10

[52] U.S. Cl. ..... 431/80; 431/75; 431/264

[58] Field of Search ..... 431/75, 76, 80, 264, 431/343; 136/217, 220, 230

[56] References Cited

U.S. PATENT DOCUMENTS

| | | | |
|---|---|---|---|
| 3,286,762 | 11/1966 | McIntosh et al. | 431/80 |
| 3,291,649 | 12/1966 | Craemer et al. | 431/80 |
| 3,519,491 | 7/1970 | Grohall et al. | 431/80 X |
| 3,521,982 | 7/1970 | Dunn | 431/80 |

*Primary Examiner*—Larry Jones

*Attorney, Agent, or Firm*—Gregory A. Bruns

[57] ABSTRACT

A combination pilot burner and generator including a pilot burner head for deflecting a pilot flame in a given direction. The proper location of the generator for optimum flame sensing is assured by securing the generator to the pilot burner head by welding or other securement.

5 Claims, 1 Drawing Sheet

INTEGRAL PILOT BURNER-GENERATOR

This application is a continuation of application Ser. No. 07/375,115, filed June 30, 1989 now abandoned.

BACKGROUND OF THE INVENTION

The present invention relates generally to gas pilot safety systems and particularly to pilot burners for use with flame sensing generators such as thermopiles or thermocouples.

Pilot burners and generators that are physically separate are widely used to assure that a pilot flame is available before allowing gas flow to a main burner. For example, the generator may include a thermocouple which generates a millivolt output when it is heated by the pilot burner. The millivolt output must be present in order for the safety system to allow the gas valve to open. Rather precise placement of the generator with respect to the pilot burner is required to assure accurate flame sensing.

In the past various methods have been used for mounting the pilot burner in proximity to the main burner and for mounting the physically separate generator so that it will properly sense the heat from the pilot flame. A common method is to use a bracket having one location for the mounting of the pilot burner and a separate location for the mounting of the generator.

U.S. Pat. No. 3,173,472 issued to Roger S. Loveland on Mar. 16, 1965 and U.S. Pat. No. 3,930,892 issued to Donnel H. Fox et al on Jan. 6, 1976 are illustrative of past methods used for mounting pilot burner and generators.

The past methods have the disadvantage of requiring precise placement of the generator with respect to the pilot burner to assure accurate flame sensing. Generators are frequently replaced in the field and the variety of generator types and mounting arrangements makes it difficult to achieve the precise placement of the generator.

Thus a need exists for a pilot burner and generator that eliminates problems associated with placement of a generator relative to a pilot burner.

SUMMARY OF THE INVENTION

The present invention solves these and other needs by providing an integral pilot burner and generator. A pilot burner body and a target type pilot burner head are provided. The burner head deflects the pilot flame in a predetermined direction. A generator having a flame sensing end is secured directly to the pilot burner head to optimize the flame sensing function.

DESCRIPTION OF THE PREFERRED EMBODIMENT

Figure 1:
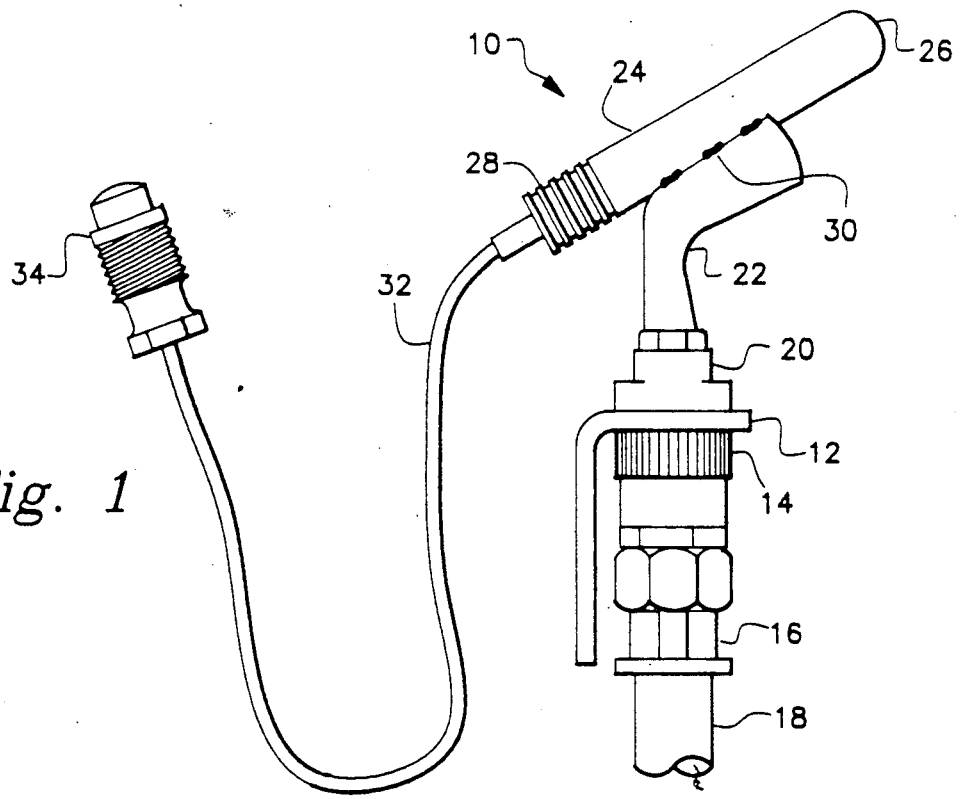
FIG. 1 is a side view of a combination pilot burner and generator in accordance with applicant's invention.
Figure 2:
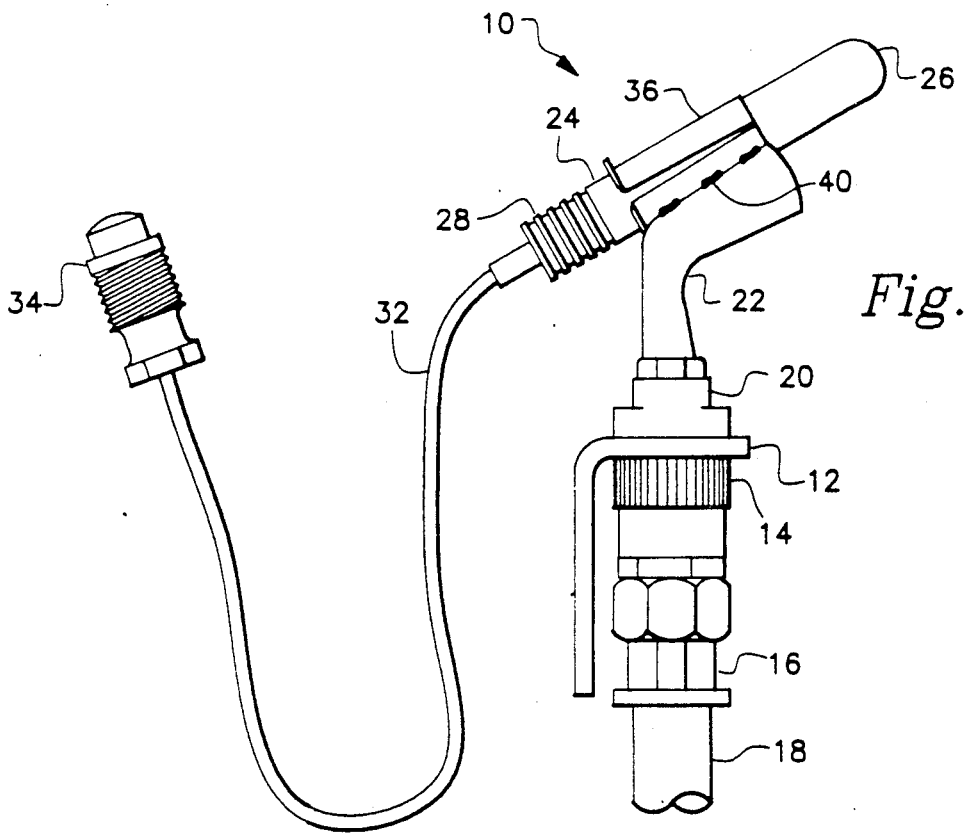
FIG. 2 is a side view of an alternative embodiment of a pilot burner and generator in accordance with applicant's invention.

In FIG. 1, reference numeral 10 identifies an integral pilot burner and generator in accordance with applicant's invention.

The embodiment shown includes a mounting bracket 12 on which the integral pilot burner and generator 10 is mounted. The pilot burner includes a burner body 14 which has a connector 16 for attaching fuel supply line 18. Burner body 14 is supplied with fuel at its lower end by fuel supply line 18 and issues fuel for the pilot flame at its upper end 20. A target type of burner head 22 is attached to burner body 14 and is designed to deflect a pilot flame in a predetermined direction which is suitable for igniting the main burner.

Millivolt generator 24 is a thermocouple, thermopile or other similar device. Generator 24 is of an elongated tubular shape and has a flame sensing end 26 and an electrical connection end 28. Generator 24 also has an electrical conductor 32 and a connector 34 for connection to an electromagnetic safety power unit of a gas valve or the like. According to the teachings of the present invention generator 24 is firmly secured to burner head 22. The specific location of generator 24 may be determined at the factory so as to optimize the flame sensing output of generator 24 for a given burner head and generator design configuration.

Securement of generator 24 to burner head 22 may be by welding at 30. When welding is used a positive return ground electrical path is provided by the weld. An alternative method of securement is to utilize a sleeve or clip 36. Clip 36 may be firmly secured, for example by welding at 40, to burner head 22. Generator 24 is then firmly secured by clip 36.

Now that the construction and operation of device 10 have been set forth, many advantages can be further set forth and appreciated.

In the past a pilot burner and a generator have been separate devices. Various mounting arrangements have been used and typically a bracket is provided which has separate mounting locations for the pilot burner and the generator. Separate screw attachment methods may then be used for attaching the pilot burner and generator to the bracket.

The past method lends itself to possible use of an improper generator, location of the flame sensing tip in an improper location or other improper installations. For example it may be appreciated that a pilot burner installed according to the past method may be rotated so that the pilot flame is not in the proper direction for flame sensing. In addition the pilot burner may be installed with the flame either too high or too low.

It may be further appreciated that the generator may be installed with the flame sensing tip either too high or too low with respect to the pilot burner.

Further, the existing generators are frequently replaced in the field by contractors, service companies and the homeowner. This field replacement increases the likelihood that the generator will be improperly installed. An improper installation can cause the primary safety system to operate in an improper manner, and could possibly render the system unsafe.

Applicant's invention locates the generator in a precise location at the factory. Therefore the precise relationship of pilot burner to generator that is required for safe operation of the burner system is set at the factory, and is not subject to change or tampering. In addition, the generator output is reliable and stable since it is not affected by wind drafts on the flame. The generator is not replaceable as a separate unit in the field.

Although a specific embodiment of applicant's invention is shown and described for illustrative purposes, a number of variations and modifications will be apparent to those of ordinary skill in the relevant arts. It is not intended that coverage be limited to the disclosed embodiment, but only by the terms of the following claims.

I claim:

1. An integral pilot burner and generator comprising:

a pilot burner body having means for issuing fuel from an outlet and being supplied form a source of said fuel at an inlet;

a burner head comprising a single "L" shaped integral element attached to said pilot burner body at said outlet, said burner head including a gas passageway, said passageway having a wall;

said burner head deflecting a pilot flame in a predetermined direction;

a generator comprising an elongated body having a longitudinal axis and a flame sensing end sensing the presence of a pilot flame; and means for fixedly securing said generator to said wall of said gas passageway at a location above the pilot burner body, with said longitudinal axis of said generator approximately parallel to said predetermined direction of said pilot flame, to assure proper positioning of said flame sensing end within said pilot flame.

2. The integral pilot burner and generator of claim 1 wherein said burner head is a target type burner head.

3. The integral pilot burner and generator of claim 2 wherein said means for permanently securing is by at least one weld.

4. The integral pilot burner and generator of claim 2 wherein said means for permanently securing said generator to said burner body is a clip.

5. An integral pilot burner and generator, comprising:

a pilot burner body having means for issuing fuel from an outlet and being supplied from a source of said fuel at an inlet;

a burner head attached to said pilot burner body and located adjacent said outlet, said burner head deflecting a pilot flame in a predetermined direction, said burner head being generally "L" shaped and having a first leg and a second leg, with said first leg attached to said burner body and said second leg forming an obtuse angle with said first leg; and a generator comprising an elongated body having a longitudinal axis and a flame sensing end sensing the presence of a pilot flame, said generator fixedly secured to said burner head at a location above the pilot burner body with said longitudinal axis of said generator generally parallel to said second leg.

* * * * *